US006701532B1

(12) United States Patent
Glassberg et al.

(10) Patent No.: US 6,701,532 B1
(45) Date of Patent: Mar. 9, 2004

(54) ELASTIC FASHION ACCESSORY BAND

(75) Inventors: Corey S. Glassberg, Dix Hills, NY (US); Jamie T. Glassberg, Dix Hills, NY (US)

(73) Assignee: Top Trenz, Inc., Bayshore, NY (US)

( * ) Notice: Subject to any disclaimer, the term of this patent is extended or adjusted under 35 U.S.C. 154(b) by 0 days.

(21) Appl. No.: 10/345,588

(22) Filed: Jan. 16, 2003

(51) Int. Cl.[7] ..... A41D 1/00
(52) U.S. Cl. ..... 2/170; 2/171
(58) Field of Search ..... 2/170, 171, 162, 2/181, 200.1, 425, 918, DIG. 11

(56) References Cited

U.S. PATENT DOCUMENTS

| | | | | | |
|---|---|---|---|---|---|
| D122,104 | S | | 8/1940 | Wolf | |
| 2,806,222 | A | * | 9/1957 | Carpenter | 2/91 |
| 3,586,001 | A | | 6/1971 | Sanderson | |
| 4,047,400 | A | * | 9/1977 | Thorneburg | 66/171 |
| 4,091,766 | A | | 5/1978 | Colliard | |
| D267,200 | S | | 12/1982 | Milding | |
| 4,365,354 | A | | 12/1982 | Sullivan | |
| 4,393,519 | A | | 7/1983 | Nicastro | |
| D272,865 | S | | 3/1984 | Edelmann | |
| 4,499,741 | A | * | 2/1985 | Harris | 66/171 |
| 4,667,345 | A | * | 5/1987 | Jachowski | 2/91 |
| 4,833,734 | A | * | 5/1989 | Der Estephanian | 2/171 |
| 4,852,189 | A | | 8/1989 | Duggan | |
| 4,918,758 | A | * | 4/1990 | Rendina | 2/171 |
| 5,046,195 | A | | 9/1991 | Koritan | |
| 5,305,470 | A | | 4/1994 | McKay | |
| 5,377,360 | A | * | 1/1995 | Fleitman | 2/181 |
| D379,257 | S | | 5/1997 | Leinoff | |
| D389,636 | S | | 1/1998 | Davis, Sr. | |
| D393,719 | S | | 4/1998 | Nichols | |
| 5,806,535 | A | * | 9/1998 | Becker | 132/54 |
| D399,036 | S | | 10/1998 | Washington | |
| 5,823,012 | A | * | 10/1998 | Hacskaylo | 66/171 |
| D405,534 | S | | 2/1999 | Hall | |
| D409,357 | S | | 5/1999 | Hirata | |
| 6,000,062 | A | * | 12/1999 | Trakh | 2/171 |
| 6,209,141 | B1 | * | 4/2001 | Adeli | 2/239 |
| 6,571,396 | B1 | * | 6/2003 | Yan | 2/195.1 |

OTHER PUBLICATIONS

Eastbay Catalogue, "Nike NCAA Authentic Tank and Short", 1997.*
Undergear, "Tactics Cross Trainer", fall 1993.*

* cited by examiner

*Primary Examiner*—Tejash Patel
(74) *Attorney, Agent, or Firm*—Schweitzer Cornman Gross & Bondell LLP

(57) ABSTRACT

An improved fashion accessory band formed of elastic material is provided, wherein opposing ends of an elongated band of elastic material are coupled together to form an annular-shaped accessory. The outer face is decorated and can include a label and one or more circumferential stripe-like decorations printed or constructed thereon, so that there is no need to cover the surface of the band with a layer of additional fabric or other covering material.

6 Claims, 2 Drawing Sheets

ELASTIC FASHION ACCESSORY BAND

FIELD OF THE INVENTION

The invention relates generally to fashion accessories and more particularly to a stylish elastic band capable of being worn with a variety of different clothing styles on virtually any part of the body.

BACKGROUND OF THE INVENTION

Elastic bands are well known and typically made in numerous sizes to accommodate a variety of accessory devices. For example, it is well known to use a small, annular elastic member to maintain a user's hair atop his or her head. Elastic bands are also commonly used as the core components of covered headbands to securely accommodate a wearer's head size. Conventional elastic bands alone, however, are often very unappealing to the eye, requiring an outer covering formed of fabric or other material. This material can add expense to the cost of manufacturing fashionable elastic band accessories, such as headbands, wristbands, and legbands. Additionally, covering an elastic band with any material will lessen the valuable gripping (non-slip) properties of the elastic band, and may result in a band that is easily dislodged from the desired area of placement. This is particularly true in the case of headbands.

Accordingly, it is an object of the present invention to provide a fashionable elastic band accessory having an attractive outer face, so that there is no need to cover the surface with a layer of additional fabric or coating material.

It is another object of the present invention to provide an elastic band having more effective non-slip properties than conventional accessory bands made with cores of elastic material.

It is a further object of the present invention to provide an accessory that is uncomplicated and inexpensive to manufacture.

SUMMARY OF THE INVENTION

In accordance with the present invention an elastic fashion accessory band having an attractive design is provided. The band is constructed from an elongated body of elastic material, typically knitted or woven, having an outer face and opposing ends. The ends of the body are converged, disposed in overlapping or abutting relation to each other and coupled together to form an annular-shaped elastic accessory having the ability to expand and retract.

In accordance with more specific features of the invention, the elastic material is provided with an attractive design, for example one or more circumferential stripe-like designs constructed or printed on the face of the elastic material. The face of the elastic accessory band preferably is further decorated with a label, for example, which may identify the source of the unique article of manufacture, while simultaneously concealing the point of attachment of the opposing ends.

DESCRIPTION OF DRAWINGS

The above and other objects, features and advantages of the present invention will become apparent from the following description of preferred, but nonetheless, illustrative embodiments of the invention, taken in, conjunction with the accompanying drawings, wherein.

DETAILED DESCRIPTION OF THE PREFERRED EMBODIMENTS

Figure 1:
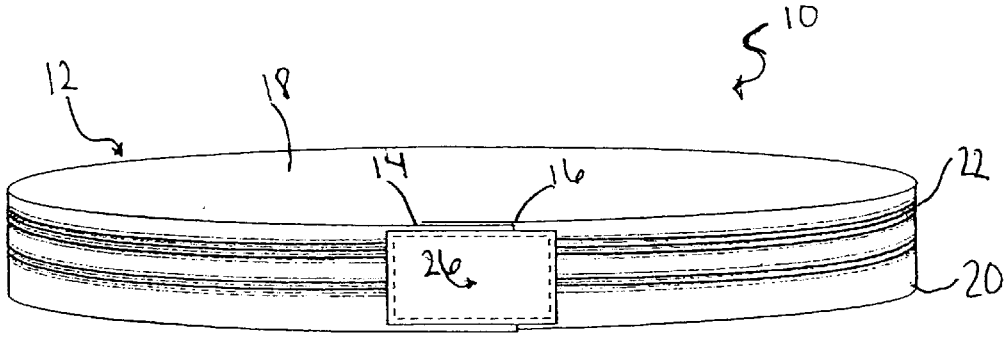
FIG. 1 is a front elevational view of an elastic accessory band in accordance with the invention.

Referring to the drawings, a preferred embodiment of the invention is illustrated in the form of a headband 10. While dimensioned to accommodate a wearer's head, the band may be sized to fit any area of the body, including the wrist or ankle, for example. The headband 10 comprises an elongated elastic body 12 of a predetermined size having opposing first and second ends 14, 16 and inner and outer faces 18,20. Preferably, the body is a knitted or woven fabric. It is most desirable to use a knit fabric which is stretchable to about two times its relaxed length to accommodate any head size.

To provide an aesthetically appealing accessory and economical article of manufacture, the outer surface of the elastic material is decorated, for example with a camouflage or tie dye pattern, a sprinkling of sequins or stones, embroidery, etc. In the illustrated embodiment, one or more stripes or stripe-like decorations 22 are constructed or printed on the exterior face 20 of the band 10, obviating, the need for a separate surface covering made of fabric or other material. The illustrated headband preferably includes one relatively wider stripe, for example comprising three adjacent rows (warps) of stitching, and two additional stripes each consisting of, for example, a single row of stitching. The headband is further dimensioned to have a width of, for example, from approximately ½ to about 3 inches, and preferably about one inch.

Figure 2:
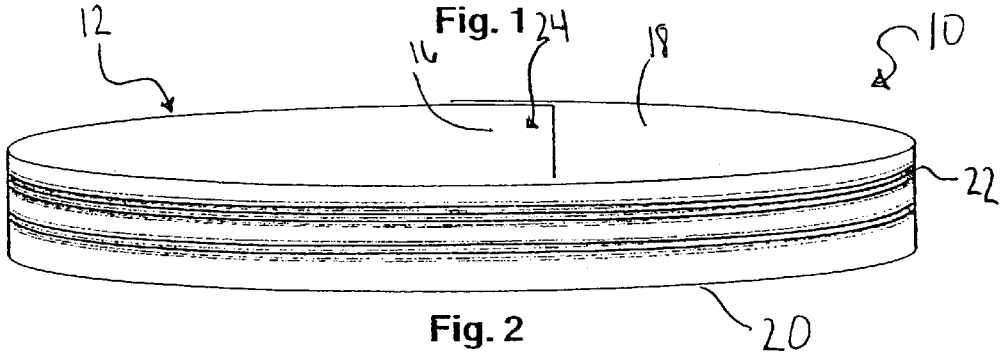
FIG. 2 is a rear elevational view of the band of FIG. 1.
Figure 3:
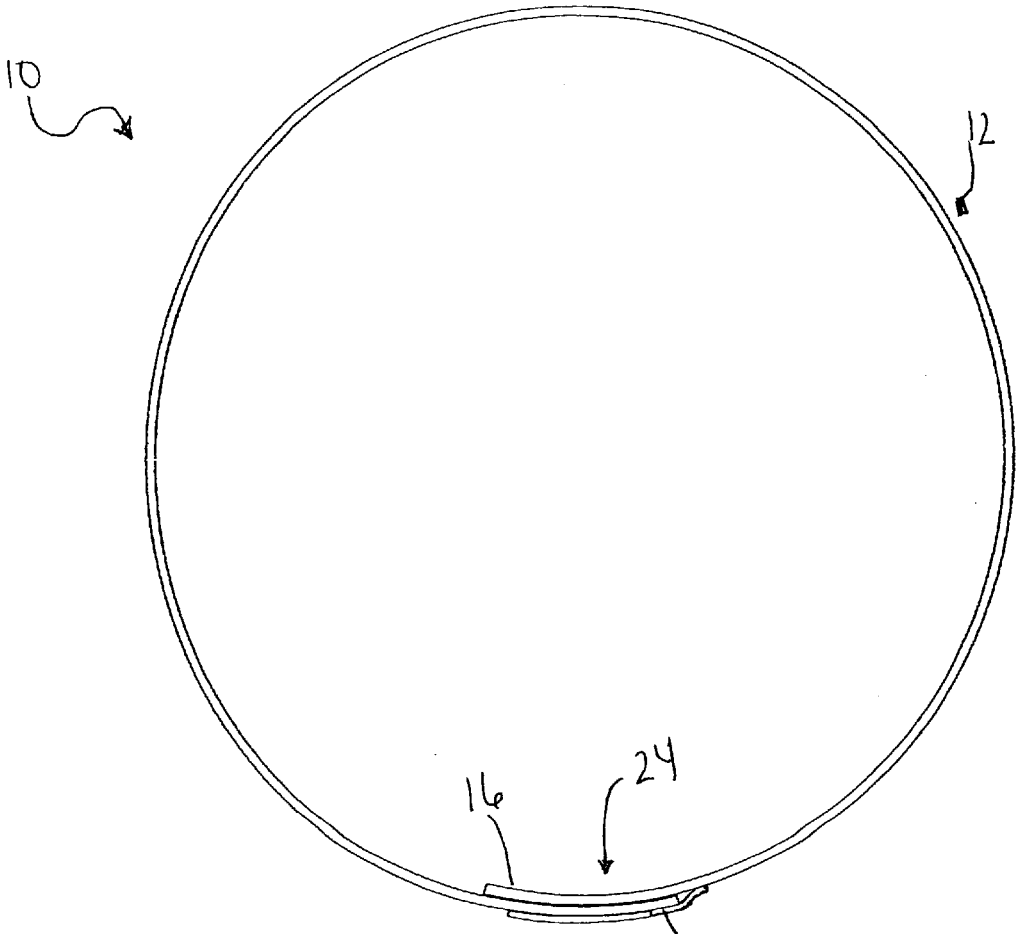
FIG. 3 is a top view of the band of FIG. 1.
Figure 4:
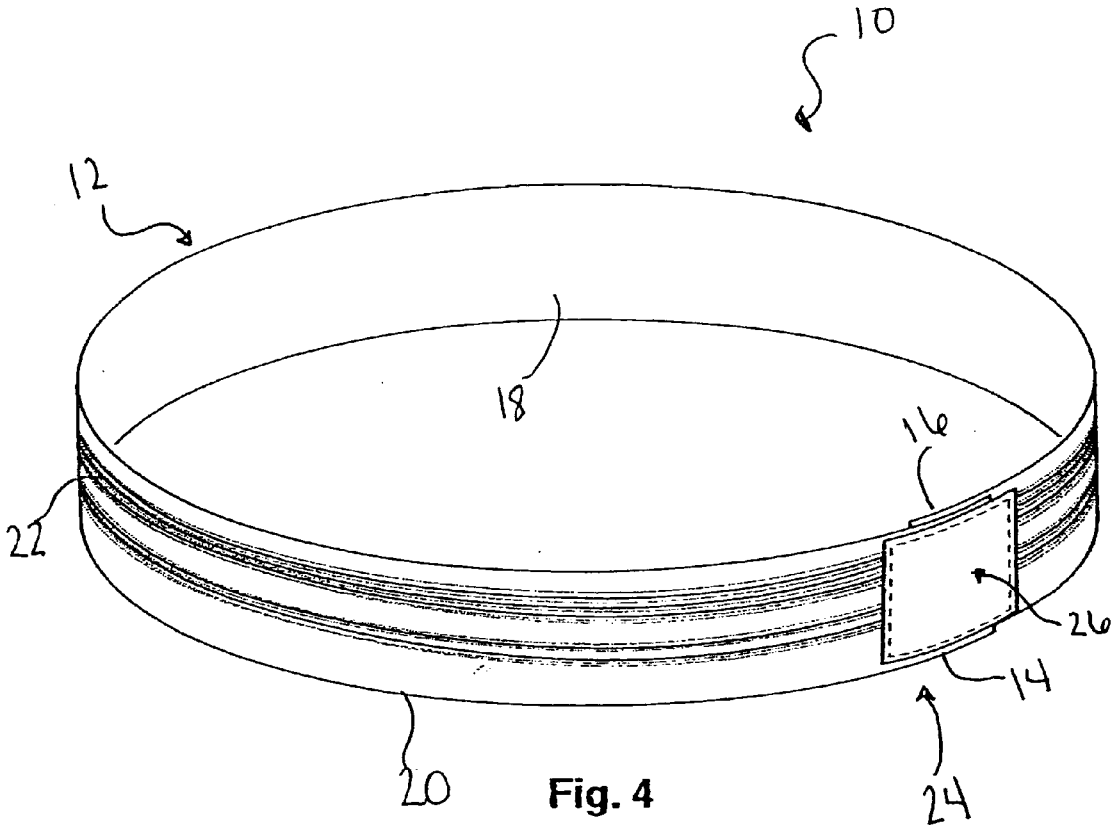
FIG. 4 is a top perspective view of the band of FIG. 1.

As most clearly seen in FIGS. 2 and 3, to form the band 10 of the present invention, the opposing ends 14, 16 of the body 12 are disposed in overlapping or abutting relation to each other. In the specifically illustrated embodiment, the first end 14 is disposed in overlapping relation to the second end 16 and coupled thereto at a portion 24 of the band 10, by any means generally known in the art. The preferred method of coupling the ends together is by sewing the first end 14 in covering relation to the second end 16. A label 26 is then affixed by sewing, adhesive bonding, etc., to the portion 24 of the band. The label 26 may be used to identify the source of the goods, while also preferably concealing the area of attachment which would otherwise be visible. Except for the label and any decorative stripes or other outer surface ornamentation, the elastic material of the band remains uncovered by any other material. This has the dual benefit of minimizing production costs and of providing a more effective gripping and non-slip action between the band and the hair and/or skin of the wearer.

The elastic band of the present invention may be made in various lengths and widths depending upon the area of the body in which the band is desirably worn. For example, where it may be desired to use the band described herein on the wearer's arm, the band would be of a shorter length and possibly a different width than would be a band designed for placement around a wearer's head. For the foregoing reasons, the scope of this invention is to be defined by reference to the appended claims.

What is claimed is:

1. An elastic fashion accessory band comprising:

(a) an elongated elastic body formed of a length of elastic material having inner and outer faces;

(b) said band having first and second opposing ends permanently coupled together to form an annular accessory band;

(c) said band comprising a single layer of said elastic material and having a decorative pattern on its outer face;

(d) except as set forth in subparagraph (c) hereof, said elastic body being substantially free of covering materials on its inner and outer surfaces;

(e) said band being made of a knitted elastic material; and (f) said band having a label secured to its outer face, wherein said label covers an exposed end of the annular band.

2. The elastic fashion accessory band of claim 1, having a predetermined size, and configured to be a headband.

3. The elastic fashion accessory band of claim 1, wherein said decorative pattern comprises at least one stripe-like decoration extending circumferentially about said band.

4. The elastic fashion accessory band of claim 1, having a predetermined size, and configured to be a headband.

5. The elastic fashion accessory band of claim 1, wherein (a) said decorative pattern comprises at least one stripe-like decoration extending circumferentially about said band.

6. An elastic fashion accessory band comprising:

(a) an elongated elastic body formed of a length of elastic material having inner and outer faces;

(b) said band having first and second opposing ends permanently coupled together to form an annular accessory band;

(c) said band comprising a single layer of said elastic material and having a decorative pattern on its outer face;

(d) except as set forth in subparagraph (c) hereof, said elastic body being substantially free of covering materials on its inner and outer surfaces; and (e) said band having a label secured to its outer face, wherein said label covers an exposed end of the annular band.

* * * * *